US009345067B2

(12) United States Patent
Biller

(10) Patent No.: US 9,345,067 B2
(45) **Date of Patent: *May 17, 2016**

(54) TEMPERATURE MONITORING AND CONTROL SYSTEM FOR NEGATIVE TEMPERATURE COEFFICIENT HEATERS

(71) Applicant: Brian C. Biller, Mentor, OH (US)

(72) Inventor: Brian C. Biller, Mentor, OH (US)

(73) Assignee: ECG Operating Company LLC, Beachwood, OH (US)

( * ) Notice: Subject to any disclaimer, the term of this patent is extended or adjusted under 35 U.S.C. 154(b) by 15 days.

This patent is subject to a terminal disclaimer.

(21) Appl. No.: 14/229,171

(22) Filed: Mar. 28, 2014

(65) Prior Publication Data

US 2014/0217087 A1 Aug. 7, 2014

Related U.S. Application Data

(63) Continuation-in-part of application No. 13/123,808, filed as application No. PCT/US2009/060490 on Oct. 13, 2009, now Pat. No. 8,716,634.

(60) Provisional application No. 61/104,798, filed on Oct. 13, 2008.

(51) Int. Cl.
*H05B 1/02* (2006.01)

(52) U.S. Cl.
CPC ..... *H05B 1/0227* (2013.01); *H05B 2203/019* (2013.01)

(58) Field of Classification Search
CPC .. H05B 1/02; H05B 1/0227; H05B 2203/019; H05B 3/13; H05B 3/023; H05B 3/026
USPC ..... 219/494, 497, 499, 505, 492, 504, 481
See application file for complete search history.

(56) References Cited

U.S. PATENT DOCUMENTS

| | | | | |
|---|---|---|---|---|
| 4,485,296 | A * | 11/1984 | Ueda et al. | 219/505 |
| 5,783,805 | A * | 7/1998 | Katzmann | 219/494 |
| 6,303,911 | B1 * | 10/2001 | Welch, Jr. | 219/497 |
| 6,933,734 | B2 * | 8/2005 | Kojima | 324/713 |
| 7,196,295 | B2 * | 3/2007 | Fennewald et al. | 219/543 |
| 2003/0093186 | A1 * | 5/2003 | Patterson et al. | 700/299 |
| 2003/0178412 | A1 * | 9/2003 | Goldberg et al. | 219/497 |
| 2005/0205549 | A1 * | 9/2005 | Crawford et al. | 219/494 |

* cited by examiner

*Primary Examiner* — Mark Paschall
(74) *Attorney, Agent, or Firm* — Tarolli, Sundheim, Covell & Tummino LLP

(57) ABSTRACT

A temperature monitoring system for a heater having a flexible, thin-film graphite heater element includes a temperature sensing component that uses the heater element to sense temperature. The temperature sensing component includes a current sensor and a voltmeter circuit for determining a resistance and temperature of the heater element. A temperature control component associated with the heater element receives at least one set point value associated with the heater and controls the temperature of the heater element based on a comparison of at least one of the resistance and temperature of the heater element to the at least one set point value. The temperature of the heater element is calculated, in Ohms, using the following equation:

$$y=Ax^3+Bx^2-Cx+D,$$

where x=the average temperature of the heater element, in degrees Fahrenheit, and y=the resistance of the heater element as a percentage of the resistance of the heater element at room temperature, where A is from about −20000 to about 25000, B is from about 40000 to about 80000, C is from about 40000 to about 80000, and D is from about 10000 to about 30000.

30 Claims, 7 Drawing Sheets

TEMPERATURE MONITORING AND CONTROL SYSTEM FOR NEGATIVE TEMPERATURE COEFFICIENT HEATERS

CROSS-REFERENCE TO RELATED APPLICATIONS

This application is a continuation-in-part of U.S. application Ser. No. 13/123,808, filed Apr. 13, 2011, which claims priority to International Application No. PCT/US2009/060490, filed Oct. 13, 2009 and U.S. Provisional Appln. No. 61/104,798, filed Oct. 13, 2008. The present application claims priority to the aforementioned patent applications, which are incorporated in their entirety herein by reference for all purposes.

FIELD OF THE INVENTION

The present invention relates to a temperature monitoring and control system for a negative temperature coefficient ("NTC") heater element and, in particular, relates to a control system that utilizes conventional circuitry without the need for an external temperature sensing device on the heater element.

BACKGROUND

A heater element that has an NTC of resistance will decrease in resistance as it heats up. Carbon based heater elements, such as graphite and carbon fiber heaters, have an NTC of resistance and, thus, can be referred to as NTC heater elements.

In heater temperature control, the thermal conductivity of a heated substrate or object is almost always relied upon to pass thermal energy to a sensor or thermostat. When the thermal conductivity is low, a delayed response is often experienced. This delay can result in catastrophic failure of the heater. A similar delay can be the result of improper mounting of the heater element or the use of the beater element for an improper application. For example, if the heater element is not held or adhered securely to the object/material to be heated, the effective thermal conductivity can be extremely low, even if the materials have a high thermal conductivity. In this case, the "effective thermal conductivity" can be defined as the material's thermal conductivity plus the thermal contact conductivity or the conductivity across the interface between the heater and the heated object/material. Often, due to thermal expansion or aging materials, the thermal transfer efficiency degrades over time. Eventually, the temperature climbs to an often dangerous level. The present invention, however, can help to prevent this temperature increase.

The thermal lag mentioned above can also cause a great deal of hysteresis about a set temperature. Often the solution to this type of problem is to use sophisticated temperature controls which use pulse-width-modulation or variable voltage to hold a temperature steady. On the other hand, the present invention can achieve tight temperature control of the heater element using a much simpler On-Off methodology, since the heat source can be held at a near constant temperature due to little to no delay in temperature sensing. The present invention can also more accurately deal with variable thermal loads, since the heat is controlled from the source.

SUMMARY OF THE INVENTION

In accordance with the present invention, a temperature monitoring system for a heater having a flexible, thin-film graphite heater element includes a temperature sensing component that uses the heater element to sense temperature. The temperature sensing component includes a current sensor and a voltmeter circuit for determining a resistance and temperature of the heater element. A temperature control component associated with the heater element receives at least one set point value associated with the heater and controls the temperature of the heater element based on a comparison of at least one of the resistance and temperature of the heater element to the at least one set point value. The temperature of the heater element is calculated, in Ohms, using the following equation:

$$y=Ax^3+Bx^2-Cx+D,$$

where x=the average temperature of the heater element, in degrees Fahrenheit, and y=the resistance of the heater element as a percentage of the resistance of the heater element at room temperature, where A is from about −20000 to about 25000, B is from about 40000 to about 80000, C is from about 40000 to about 80000, and D is from about 10000 to about 30000.

A method of monitoring temperature in a negative temperature coefficient heater having a heater element includes measuring the voltage of the heater element and measuring the current of the heater element. The resistance (y) of the heater element is calculated using Ohm's law. The average temperature (x) of the heater element is calculated based upon the calculated resistance using the following equation:

$$y=-19902x^3+59965x^2-61650x+21663.$$

DETAILED DESCRIPTION

Figure 1A:
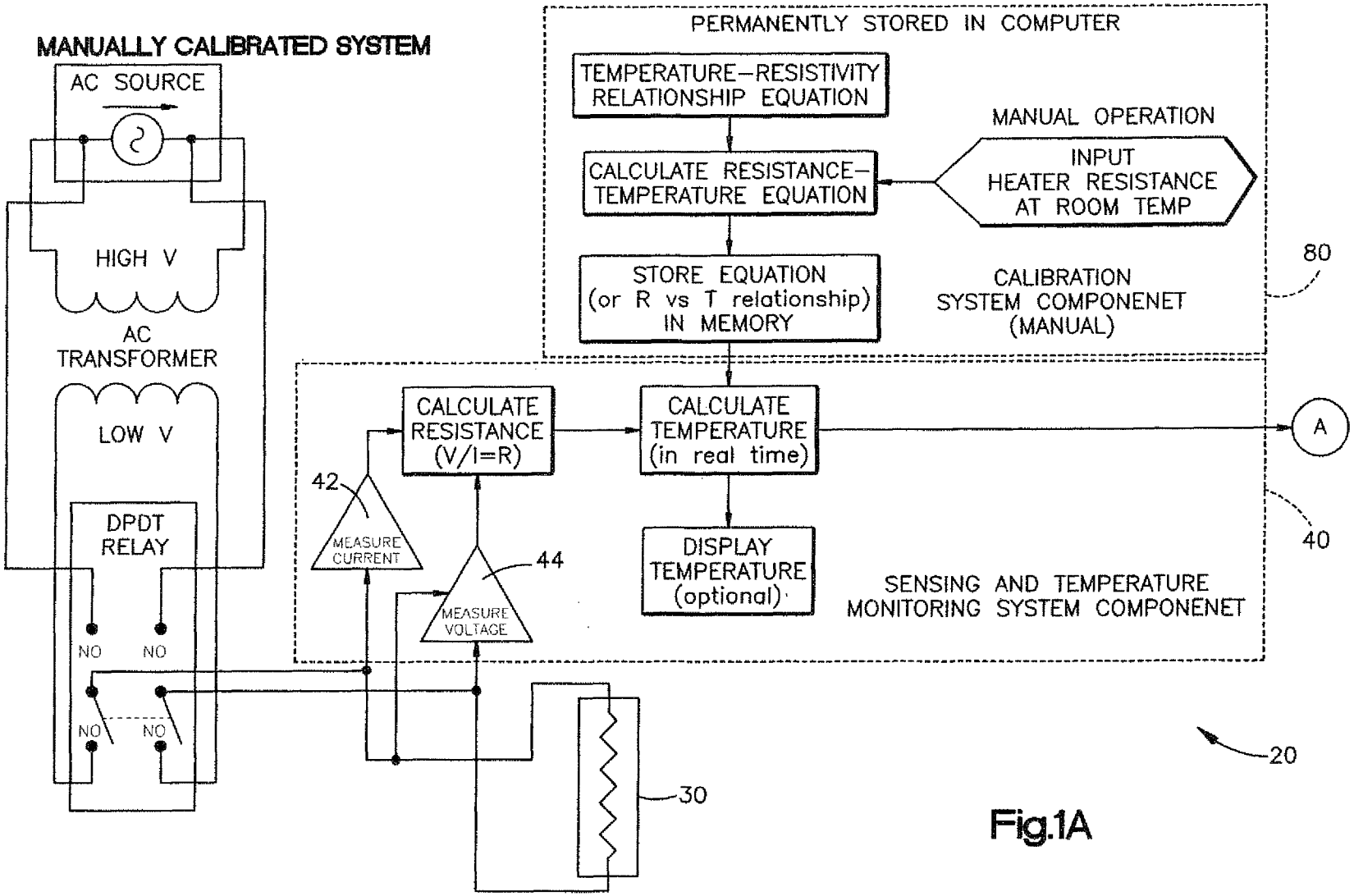
FIGS. 1A-1B depict a flowchart demonstrating a manual calibration temperature monitoring and control system in accordance with an aspect of the present invention.
Figure 1B:
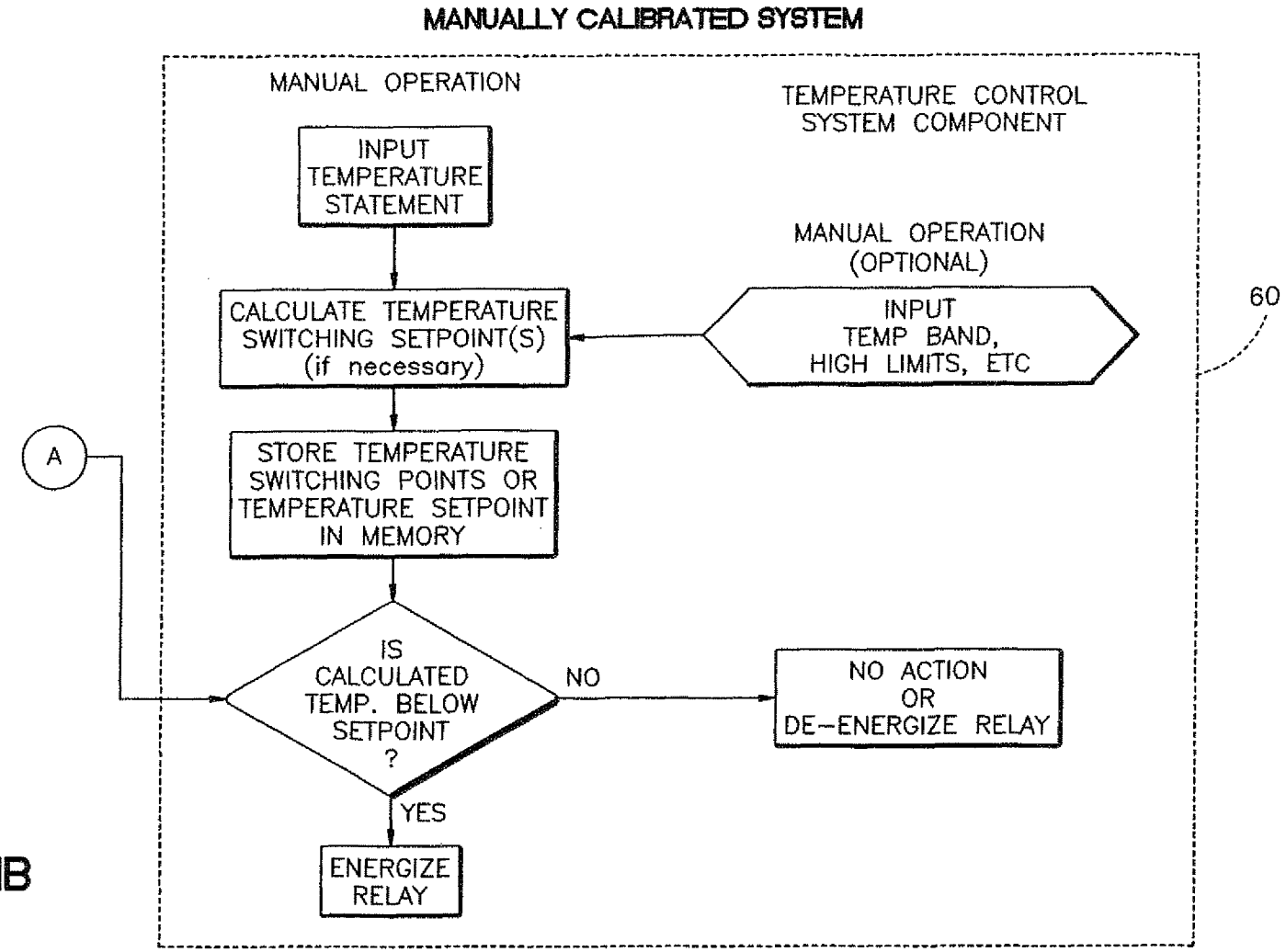

The present invention relates to a temperature monitoring and control system for an NTC heater element and, in particular, relates to a control system that utilizes conventional circuitry without the need for an external temperature sensing device on the heater element. FIGS. 1A-1B illustrate a temperature monitoring and control system 20 in accordance with an embodiment of the present invention. The system 20 utilizes conventional circuitry in a unique manner to control and/or monitor the temperature of an NTC heater 30 without the use of external temperature sensing devices on the heater element. The system 20 allows a user to control an NTC heater without the need for thermocouples, Resistance Temperature Detectors (RTDs), thermistors or other sensors. This system 20 utilizes existing technology in a new manner to measure, calculate, and display values as well as provide calibration adjustments.

The NTC heater element 30 may be constructed of a carbon-based material, such as graphite or carbon fiber. More specifically, the heater element 30 may be constructed of a flexible, thin-film graphite or carbon graphite material. Flexible graphite heater elements are particularly well suited for the system of the present invention because the temperature-resistance curve for such an NTC heater element (see FIG. 2) has sufficient amplitude to allow accurate temperatures to be calculated from the measured data. Furthermore, the resistance of flexible graphite as a function of temperature remains stable over time provided that no mechanical damage to the heater element 30 occurs. Flexible graphite is also advantageous because, in contrast to heater elements formed from other materials, flexible graphite can be repeatedly produced such that every heater element has the same characteristic temperature-resistance correlation for a given graphite construction.

Figure 2:
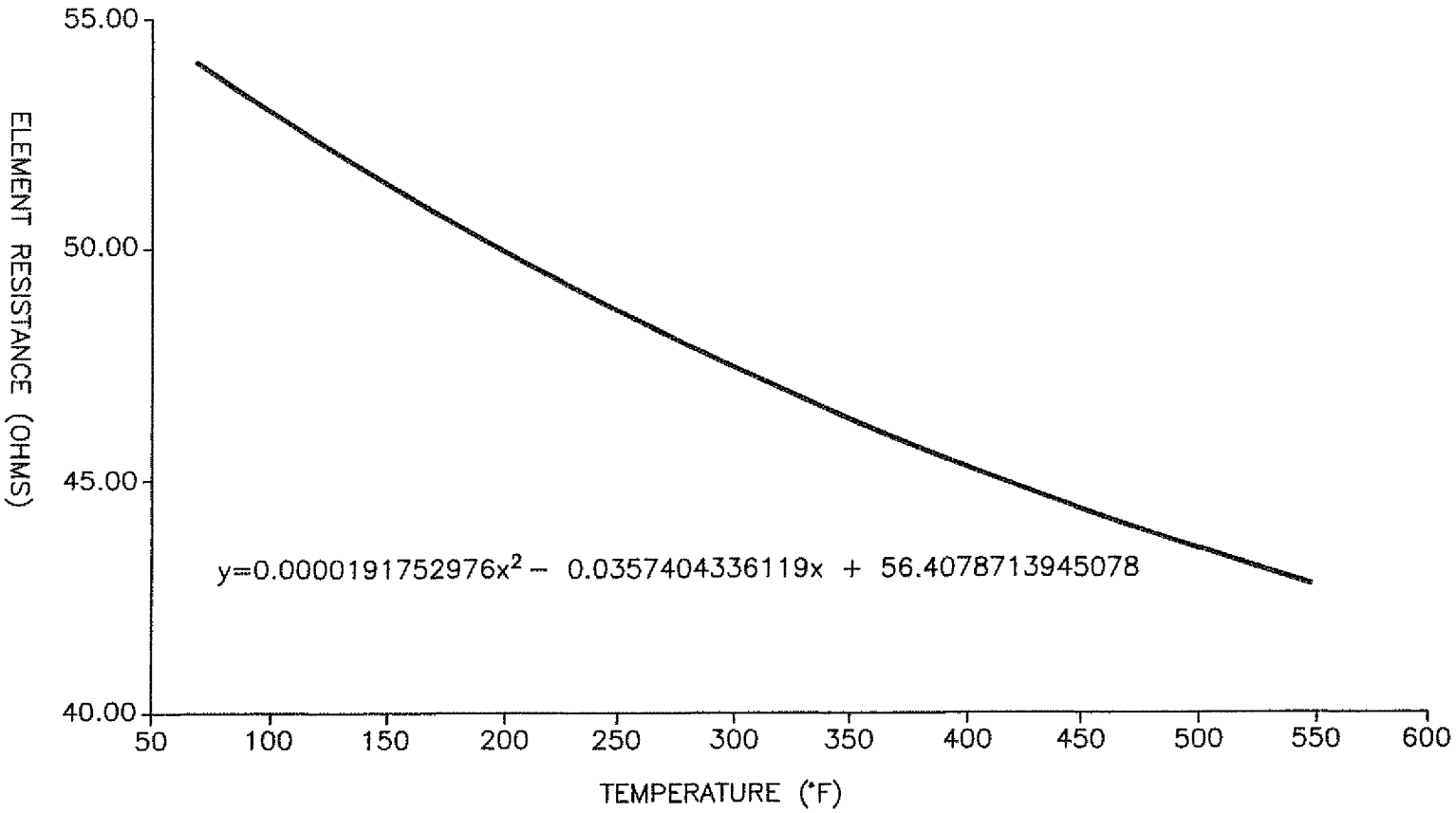
FIG. 2 is a graph illustrating an NTC heater element resistance trend for a heater element used in the control system of FIGS. 1A-1B.

Using Ohm's Law (1), an equation (2) from the trend line in FIG. 2, and an equation (3) for the average heater element temperature can be written as a function of voltage and current. More specifically, the equations can be represented by:

Ohm's Law $$V=IR \text{ or } R=V/I \tag{1}$$

Where R=Resistance in Ohms, V=Voltage in Volts, and I=Current in Amps

Graph Trend Line $$y=0.0000191752976x^2-0.0357404336119x+56.4078713945078 \tag{2}$$

Where y=Resistance in Ohms, x=Temperature in Fahrenheit

Temperature as a Function of Current/Voltage $$0.0000191752976T^2-0.0357404336119T+56.4078713945078=V/I \tag{3}$$

This function can be used within the system to control or monitor the heater element temperature. Although the graph trend line is illustrated as being a $2^{nd}$ order approximation, it will be understood that other order polynomial approximations, e.g., $3^{rd}$, $4^{th}$, $5^{th}$, etc., could be used to follow the same $2^{nd}$ order Temperature Resistance Curve along the usable range, e.g., to about 600° F., in accordance with the present invention.

The components of the system 20 include a temperature monitoring component 40, a temperature control component 60, and a system calibration component 80. The temperature monitoring component 40 of the heating system 20 includes two sensing circuits, namely, a current sensor 42 and a voltmeter circuit 44. The current sensor 42 allows the heater element's 30 supply current to pass through a low impedance resistor. This resistor may be placed on the high voltage side or the low voltage side of the heater element 30. The voltage drop across this resistor is monitored to give an exact measure of the current supplied to the heater element 30 at a given moment. Alternatively, a Hall Effect current sensor or other known sensors may be used (not shown).

The voltmeter circuit 44 monitors the DC or AC supply voltage. The measured voltage value and current values can then be used to calculate the heater element's 30 resistance/impedance. The system 20 may include signal conditioning devices such as filters or amplifiers to process the voltage and current related readings. Using Ohm's law (1), the supply voltage value can then be divided by the current value to yield a value which is proportional to the resistance of the heater element 30. This resistance value is then used in the equation (2) to mathematically calculate the heater element's 30 average temperature using the heater element's temperature coefficient of resistance, as shown in FIG. 2. The signal from either sensor 42, 44 may also be used as a variable to control the amplitude or frequency of dependant signals, which themselves could be used to calculate the heater element's 30 resistance and, thus, the heater element's temperature.

As shown in FIG. 1B, the temperature control component 60 of the system 20 includes a means of varying set point values. These set point values may include the high limits, low limits, proportional bands, etc. needed for on/off switching of the system 20 or heating element 30. The set point values may be manually entered by the user by means of rotary dials, keypads, barcodes, RFID tags, etc. In one instance, a minimum calculated resistance of the heater element 30 or a maximum temperature of the heating element corresponding with that resistance is set as a limit. Once the prescribed limit is achieved, the circuit replaces the supply voltage through the heater element 30 with a lower voltage supply that is used as a monitoring voltage while the main supply voltage is switched off. As the heater element 30 cools, the resistance of the heater element increases. When the resistance and temperature of the heater element 30 reach a reset value relative to the high temperature limit, the heater element is again energized with the higher supply voltage and the process repeated.

As an alternative, the heater element 30 may be re-energized after a predetermined period of time, rather than using a reset value (not shown). This scenario would allow the system to exclude the low voltage monitoring portion of the system, although without it, the temperature could not be displayed or monitored during the cooling portion of the cycle.

The system 20 can be manually (FIGS. 1A-1B) or automatically calibrated (FIGS. 2A-2B) for each individual heater element 30. For a manually calibrated system, as depicted in FIGS. 1A-1B, the calibration component 80 of the system 20 includes a means of varying a calibration value(s) manually. These calibration values are used to ensure proper functioning of the temperature monitoring component 40 of the system 20. The values can correspond with the heater element's 30 actual resistance at a given temperature or related values such as: temperature, temperature coefficient(s) of resistance or temperature coefficients of resistivity, and dimensional values of the heater element, e.g., length, width, etc. Calibration values may be manually entered by the user by means of rotary dials, keypads, jumpers, barcodes, RFID tags or the like.

Figure 3A:
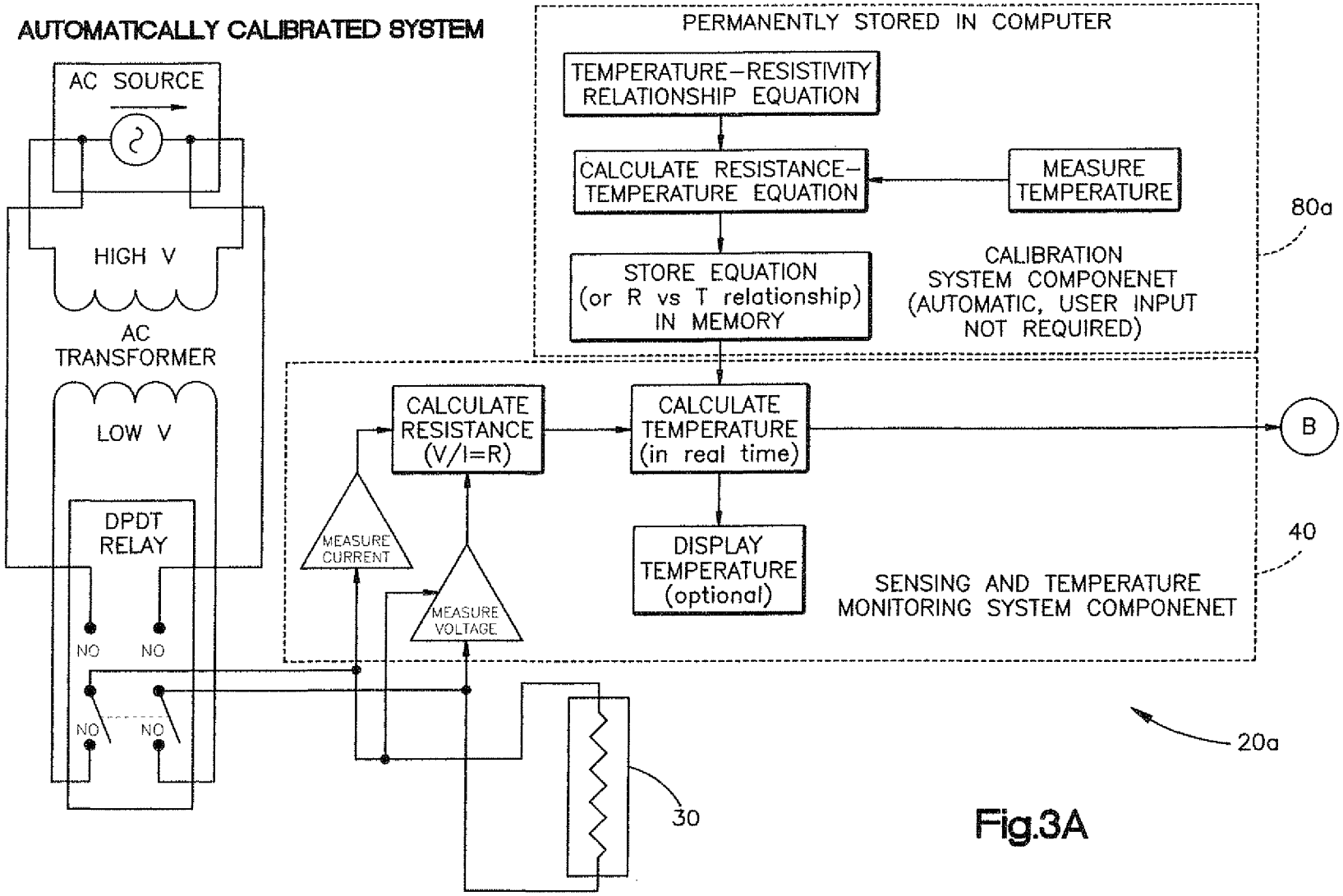
FIGS. 3A-3B depict a flowchart demonstrating an automatic calibration temperature monitoring and control system in accordance with another aspect of the present invention.
Figure 3B:
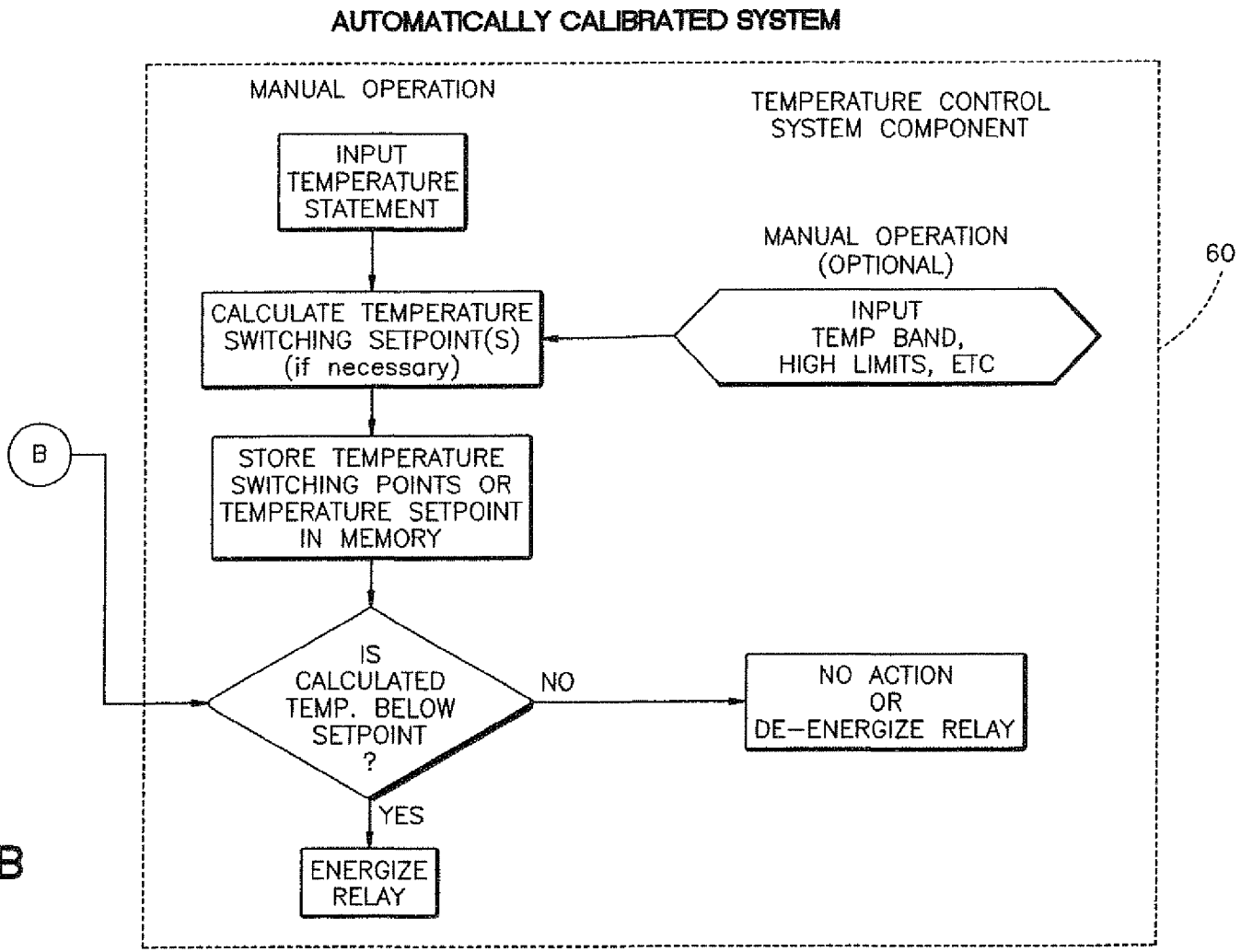

In an automatic calibrated system, as depicted in FIGS. 3A-3B, the calibration component 80*a* of the system 20*a* includes a means of varying a calibration value(s) automatically. Furthermore, at least two additional sensing circuits are required, namely, a circuit to measure the heater element's 30 resistance at ambient temperature and a circuit to measure the ambient temperature. The heater element's 30 resistance could be measured using an ohmmeter circuit or in a manner similar to the low voltage sensing circuit mentioned above. A temperature probe and sensing circuit within the system 20*a* would provide the ambient temperature value necessary to complete the calibration of the system. Users could activate the calibration manually using a button, switch, or other actuating device.

A simplified version of the system 20 or 20*a* may be used as an overheating protection for the heater element 30 or the object(s) being heated by the heater element. In particular, at a preset high temperature or low resistance limit, the power to the heater would be removed, thereby protecting the heater element 30 or heated object(s). Breakers, switches, fuses, relays, and the like may be used to remove power from the heater and thereby turn the heater element 30 off. In this particular construction, the low voltage temperature monitoring or time-based switching portion of the system 20 or 20*a* would also be excluded.

The present invention eliminates the need for external temperature sensors since the heater element 30 itself is used to sense temperature. Since no external temperature sensors are used, the system 20 or 20*a* wiring may be greatly simplified, thereby allowing for easier installation. The elimination of external sensors will also save money, decrease the weight of the system 20 or 20*a*, and reduce the size of the system. Eliminating external sensors will also eliminate the chance of controller damage due to high voltage feedback through a sensor wire.

There are many benefits that the present invention provides over conventional control methodology. These benefits include, but are not limited to: the elimination of sensor placement issues, the elimination of sensor contact issues, improved protection from damaging temperatures, substantial reduction of system temperature hysteresis, possible cost savings, and simplified wiring. Another benefit of the present invention is the protection of sensitive materials or heater insulation from damage due to excessive heat. The present invention can also be used to control the heating of thermal insulators or materials having a low thermal conductivity or effective thermal conductivity.

The system 20 or 20*a* or the present invention can be beneficial in many common applications as illustrated in the following table:

| Application Examples | Benefits |
|---|---|
| Heated Plastic Coffee Cup | Quickly heat insulative materials without overheating: Heater can respond quickly without the plastic overheating. A single sensor will only accurately sense a tiny area due to the plastic's low thermal conductivity |
| Process Heater (Heater clamped between plates) | Increased heater life: Heater may lose clamp load over time. Heated system will indicate that service is required by a decrease in plate temperature (as opposed to heater failure). Original performance will return once fasteners are tightened. |
| Convective Air Heater (Thin-Film Heater Suspended in Air) | No mounting substrate or sensors required: No additional mass is required for sensor mounting and air flow will not be disrupted by sensors |
| Food Holding/Warming Panel | Control gives a better approximation of average temperature across the entire panel or heater zone. Temperature fluctuation is kept to a minimum. Heater is able to easily handle variable thermal loads (more/less food containers on panel). |

EXAMPLE 1

In this example the NTC heater elements were formed from a flexible, thin-film graphite material. The raw material used to form the thin film was a flexible graphite foil having a thickness from about 0.001" to about 0.100". The density of the films ranged from about 40 lbs/in$^3$ to about 130 lbs/in$^3$. The temperature of each flexible graphite heater was calculated using the following equation:

$$Y=AX^2-BX+C \quad (4)$$

Where:

X=the average temperature of the flexible graphite element (for temperatures from about 32° F. to about 600° F.);

Y=the resistance of the heater element as a percentage of the element resistance at room temperature or about 70° F.; and A, B, and C are constants.

Figure 4:
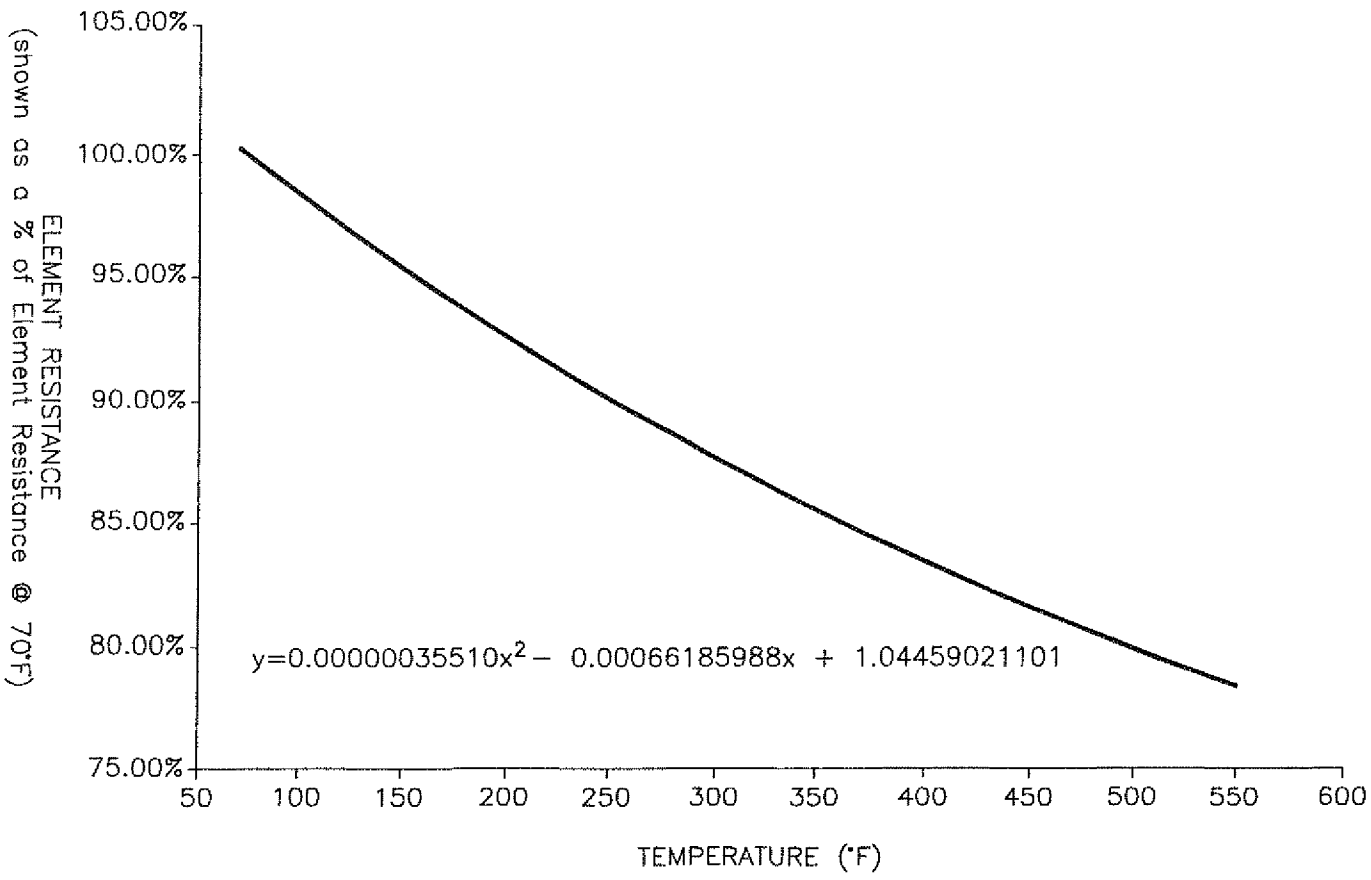
FIG. 4 is a graph illustrating another NTC heater element resistance trend.

In the present example, and for most flexible graphite materials, A=0.000000355, B=0.000661860, and C=1.0446. The flexible graphite material, however, can be manipulated during manufacturing to alter the values of A, B, and C according to particular design criterion. For example, in alternate configurations, A could range from about 0.00000025 to about 0.00000045, B could range from about 0.00056 to about 0.00076, and C could range from about 1.02 to about 1.07. A graph based on the equation (4) that illustrates the relationship between the temperature of the graphite heater element based on the heater element resistance can be generated as shown in FIG. 4.

Accordingly, during operation of the heater, the temperature monitoring system can calculate the resistance of the graphite heater element based on information received from the current sensor and the voltmeter circuit without the need for additional or external temperature sensors for sensing the temperature of the heater element. This calculated resistance, in conjunction with the known resistance of the heater element at ambient conditions, is then used to mathematically calculate the heater element's average temperature using the equation (4).

An equivalent equation can likewise be generated using the equation (4) and the following equation:

$$\text{Resistance}=\text{Volume Resistivity}*(\text{element trace length}/\text{element trace cross-sectional area})$$

Where "Resistivity" is measured at 70° F. Additional variables representing the element trace length, width and thickness would vary from heater element to heater element.

EXAMPLE 2

In this example the NTC heater elements were formed from a flexible, thin-film graphite material. The raw material used to form the thin film was a flexible graphite foil having a thickness from about 0.001" to about 0.100". The density of the films ranged from about 40 lbs/in$^3$ to about 130 lbs/in$^3$. The temperature of each flexible graphite heater was calculated using the following equation:

$$Y=AX^2-BX+C \quad (5)$$

Where:

X the average temperature of the flexible graphite element (for temperatures from about −40° F. to about 600° F.);

Y=the resistance of the heater element as a percentage of the element resistance at room temperature or about 70° F.; and A, B, and C are constants.

Figure 5:
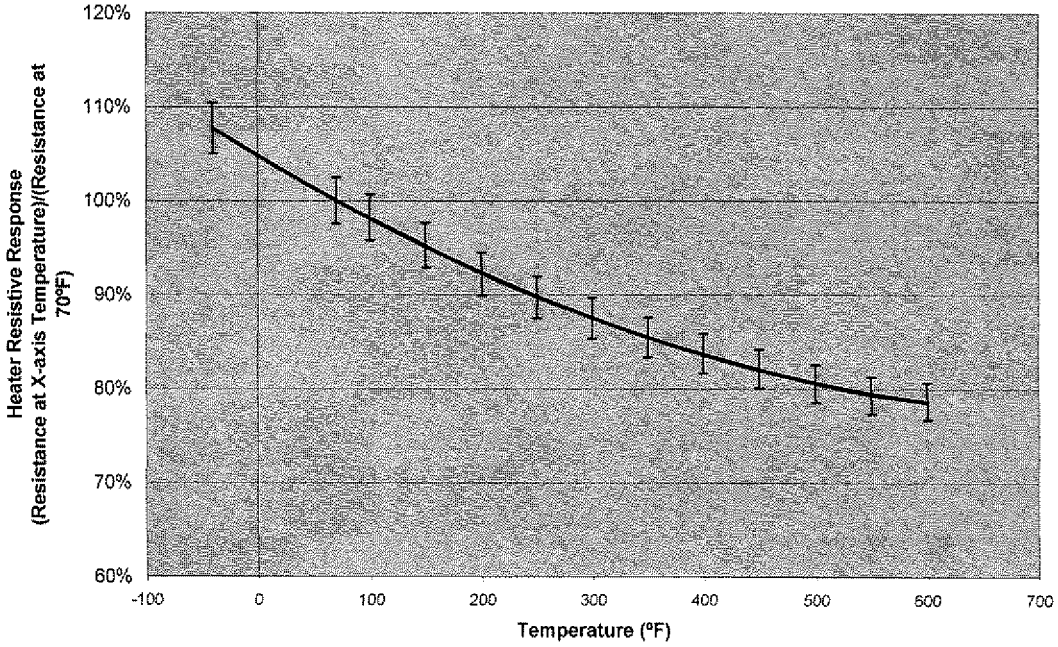
FIG. 5 is a graph illustrating another NTC heater element resistance trend.

In the present example, and for most flexible graphite materials, A=0.000000464, B=0.000715, and C=1.05. The flexible graphite material, however, can be manipulated during manufacturing to alter the values of A, B, and C according to particular design criterion. For example, in alternate configurations, A could range from about 0.00000030 to about 0.00000055, B could range from about 0.00066 to about 0.00078, and C could range from about 1 to about 1.1. A graph based on the equation (5) that illustrates the relationship between the temperature of the graphite heater element based on the heater element resistance can be generated as shown in FIG. 5. The following are examples of equations closely approximating the curve shown in FIG. 5 that may be used to control the graphite heater element:

$$y=0.0000003551x^2-0.00066186x+1.0446$$

$$y=0.00000035338x^2-0.00066471x+1.0448$$

$$y=0.00000046335x^2-0.00071268x+1.0476$$

Furthermore, it will be appreciated that higher order equations may be used to approximate the curve shown in FIG. 5 and control the graphite heater element, such as:

$$y=-0.000000000059477x^3+0.00000032688x^2-0.00061837x+1.0389$$

Figure 6:
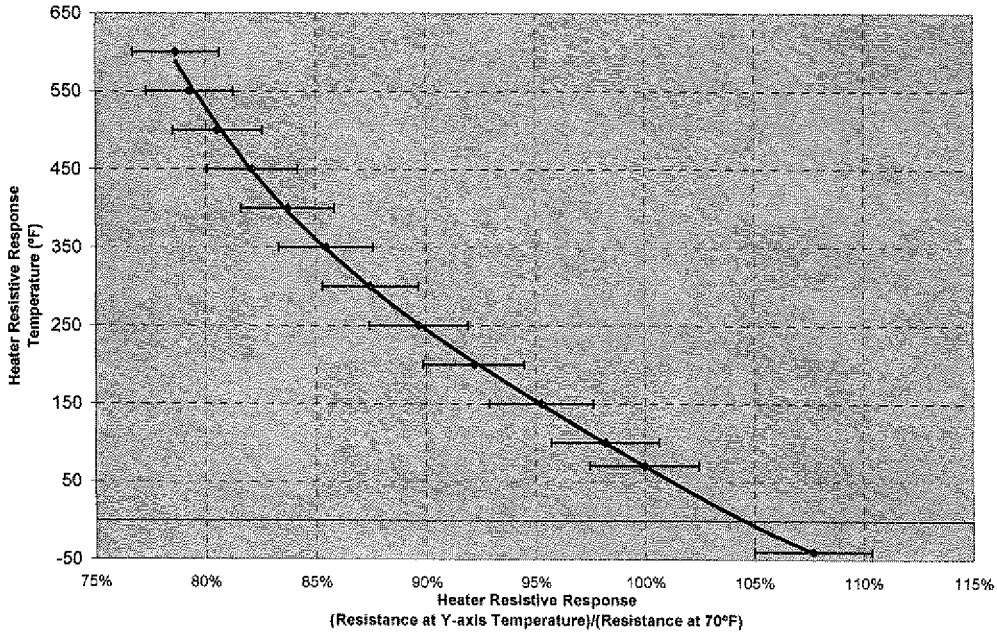
FIG. 6 is a graph illustrating another NTC heater element resistance trend.

Alternatively, the X and Y axes may be switched to create the graph shown in FIG. 6, which may also be used to control the graphite heater element. Several equations of varying order may be used to approximate the plot shown in FIG. 6 to control the graphite heater element. For example, the following linear equation may be used:

$$Y=AX+B \quad (6)$$

Where:

X=the average temperature of the flexible graphite element (for temperatures from about −40° F. to about 350° F.);

Y=the resistance of the heater element as a percentage of the element resistance at room temperature or about 70° F.; and A and B are constants.

With this linear equation (6), A could range from about −2100 to about −1600 and B could range from about 1675 to about 2070. One example of a linear equation falling within the error bars shown in FIG. 6 that can be used to control the graphite heater element is:

$$y=-1602.4x+1678.8$$

In another instance, the following second order equation could be used to control the graphite heating element:

$$Y=AX^2-BX+C \quad (7)$$

Where:

X=the average temperature of the flexible graphite element (for temperatures from about −40° F. to about 600° F.);

Y=the resistance of the heater element as a percentage of the element resistance at room temperature or about 70° F.; and A, B, and C are constants.

With this second order equation (7), A could range from about 4000 to about 5000, B could range from about 9000 to about 11000, and C could range from about 5000 to about 7000. One example of a second order equation falling within the error bars shown in FIG. 6 that can be used to control the graphite heater element is:

$$y=4470.3x^2-10384x+5972$$

In another instance, the following third order equation could be used to control the graphite heater element:

$$Y=AX^3+BX^2-CX+D \quad (8)$$

Where:

X=the average temperature of the flexible graphite element (for temperatures from about −40° F. to about 600° F.);

Y=the resistance of the heater element as a percentage of the element resistance at room temperature or about 70° F.; and A, B, C, and D are constants.

With this third order equation (8), A could range from about −20000 to about 25000, B could range from about 40000 to about 80000, C could range from about 40000 to about 80000, and D could range from about 10000 to about 30000. One example of a third order equation falling within the error bars shown in FIG. 6 that can be used to control the graphite heater element is:

$$y=-19902x^3+59965x^2-61650x+21663$$

Furthermore, it will be appreciated that higher order equations may be used to approximate the curve shown in FIG. 6 and control the graphite heater element, such as:

$$y=100270x^4-391873x^3+575222x^2-377526x+93977$$

Accordingly, during operation of the heater, the temperature monitoring system can calculate the resistance of the graphite heater element based on information received from the current sensor and the voltmeter circuit without the need for additional or external temperature sensors for sensing the temperature of the heater element. This calculated resistance, in conjunction with the known resistance of the heater element at ambient conditions, is then used to mathematically calculate the heater element's average temperature using the equations (5)-(8).

An equivalent equation can likewise be generated using the equations (5)-(8) and the following equation:

Resistance=Volume Resistivity*(element trace length/element trace cross-sectional area)

Where "Resistivity" is measured at 70° F. Additional variables representing the element trace length, width and thickness would vary from heater element to heater element.

While various features are presented above, it should be understood that the features may be used singly or in any combination thereof. Further, it should be understood that variations and modifications may occur to those skilled in the art to which the claimed examples pertain. The examples described herein are exemplary only. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

Having described the invention, the following is claimed:

1. A temperature monitoring system for a heater having a flexible, thin-film graphite heater element comprising:

a temperature sensing component that uses the heater element to sense temperature, the temperature sensing component including a current sensor and a voltmeter circuit for determining a resistance and temperature of the heater element; and a temperature control component associated with the heater element, the temperature control component receiving at least one set point value associated with the heater and controlling the temperature of the heater element based on a comparison of at least one of the resistance and temperature of the heater element to the at least one set point value, wherein the temperature of the heater element is calculated using the following equation:

$$y=Ax^3+Bx^2-Cx+D,$$

where x=the average temperature of the heater element, in degrees Fahrenheit, and y=the resistance of the heater element as a percentage of the resistance of the heater element at room temperature, where A is from about −20000 to about 25000, B is from about 40000 to about 80000, C is from about 40000 to about 80000, and D is from about 10000 to about 30000.

2. The temperature monitoring system of claim 1, wherein A is −19902, B is 59965, C is 61650, and D is 21663.

3. The temperature monitoring system of claim 1, wherein the temperature control component includes means for varying the at least one set point value.

4. The temperature monitoring system of claim 3, wherein the at least one set point value includes one or more of high limits, low limits, and proportional bands.

5. The temperature monitoring system of claim 3, further comprising means for entering the set point value.

6. The temperature monitoring system of claim 1 further comprising a calibration component for calibrating the system.

7. The temperature monitoring system of claim 6, wherein the calibration component is either manual or automatic.

8. The temperature monitoring system of claim 6, wherein the calibration component is manual and includes means for varying a calibration value.

9. The temperature monitoring system of claim 8, wherein the calibration value includes one or more of the heater element's actual resistance at a given temperature, the temperature of the heater element, the temperature coefficient of resistance, the temperature coefficient of resistivity, and dimensional values of the heater element.

10. The temperature monitoring system of claim 9, wherein the temperature calibration is automatic and includes a circuit for measuring the heater element's resistance at ambient temperature and a circuit for measuring the ambient temperature.

11. The temperature monitoring system of claim 10, wherein the circuit for measuring the heater element's resistance includes an ohmmeter circuit and the circuit for measuring the ambient temperature includes a temperature probe and sensing circuit.

12. The temperature monitoring system of claim 1, wherein the at least one set point value is a high temperature limit, the temperature control component applying a first voltage to the heater element until the temperature of the heater element exceeds the high temperature limit, the temperature control component then replacing the first voltage with a second, lower voltage while the temperature of the heater element decreases.

13. The temperature monitoring system of claim 12, wherein the temperature control component applies the second voltage to the heater element until the temperature of the heater element decreases to a reset value lower than the high temperature limit, the temperature control unit then replacing the second voltage with the first voltage.

14. The temperature monitoring system of claim 1, wherein the resistance of the heater element decreases as the temperature of the heater element increases.

15. The temperature monitoring system of claim 1, wherein the temperature control unit applies voltage to the heater element regardless of the heater element temperature.

16. The temperature monitoring system of claim 1, wherein the at least one set point value is a high temperature limit, the temperature control component applying a first voltage to the heater element until the temperature of the heater element exceeds the high temperature limit, the temperature control component then replacing the first voltage with a second, lower voltage while the temperature of the heater element decreases.

17. The temperature monitoring system of claim 16, wherein the temperature control component applies the second voltage to the heater element until the temperature of the heater element decreases to a reset value lower than the high temperature limit, the temperature control unit then replacing the second voltage with the first voltage.

18. A temperature monitoring system for a heater having a flexible, thin-film graphite heater element comprising:

a temperature sensing component that uses the heater element to sense temperature, the temperature sensing component including a current sensor and a voltmeter circuit for determining a resistance and temperature of the heater element; and a temperature control component associated with the heater element, the temperature control component receiving at least one set point value associated with the heater and controlling the temperature of the heater element based on a comparison of at least one of the resistance and temperature of the heater element to the at least one set point value, wherein the temperature of the heater element is calculated using the following equation:

$$y=Ax^2-Bx+C,$$

where x=the average temperature of the heater element, in degrees Fahrenheit, and y the resistance of the heater element as a percentage of the resistance of the heater element at room temperature, where A is from about 4000 to about 5000, B is from about 9000 to about 11000, and C is from about 5000 to about 7000.

19. The temperature monitoring system of claim 18, wherein A is 4470.3, B is 10384, and C is 5972.

20. A temperature monitoring system for a heater having a flexible, thin-film graphite heater element comprising:

a temperature sensing component that uses the heater element to sense temperature, the temperature sensing component including a current sensor and a voltmeter circuit for determining a resistance and temperature of the heater element; and a temperature control component associated with the heater element, the temperature control component receiving at least one set point value associated with the heater and controlling the temperature of the heater element based on a comparison of at least one of the resistance and temperature of the heater element to the at least one set point value, wherein the temperature of the heater element is calculated using the following equation:

$$y=Ax+B,$$

where x=the average temperature of the heater element, in degrees Fahrenheit, and y=the resistance of the heater element as a percentage of the resistance of the heater element at room temperature, where A is from about −2011 to about −1600 and B is from about 1675 to about 2070.

21. A temperature monitoring system for a heater having a flexible, thin-film graphite heater element comprising:

a temperature sensing component that uses the heater element to sense temperature, the temperature sensing component including a current sensor and a voltmeter circuit for determining a resistance and temperature of the heater element; and a temperature control component associated with the heater element, the temperature control component receiving at least one set point value associated with the heater and controlling the temperature of the heater element based on a comparison of at least one of the resistance and temperature of the heater element to the at least one set point value, wherein the temperature of the heater element is calculated using the following equation:

$$y=Ax^2-Bx+C,$$

where x=the average temperature of the heater element, in degrees Fahrenheit, and y=the resistance of the heater element as a percentage of the resistance of the heater element at room temperature, where A is from about 0.00000030 to about 0.00000055, B is from about 0.00068 to about 0.00078, and C is from about 1.0 to about 1.1.

22. The temperature monitoring system of claim 21, wherein A is .000000464, B is 0.000715, and C is 1.05.

23. The temperature monitoring system of claim 21, wherein A is .00000035510, B is 0.00066186, and C is 1.0446.

24. The temperature monitoring system of claim 21, wherein A is .00000035338, B is 0.00066471, and C is 1.0448.

25. The temperature monitoring system of claim 21, wherein A is .00000046335, B is 0.00071268, and C is 1.0476.

26. A method of monitoring temperature in a negative temperature coefficient heater having a heater element comprising:

measuring the voltage of the heater element;

measuring the current of the heater element;

calculating the resistance (y) of the heater element using Ohm's law; and calculating the average temperature (x) of the heater element in degrees Fahrenheit, based upon the calculated resistance using the following equation:

$$y=-19902x^3+59965x^2-61650x+21663.$$

27. The method of claim 26, wherein the step of measuring the voltage of the heater element comprises measuring the voltage of a flexible, thin-film graphite heater element.

28. The method of claim 26 further comprising the steps of:

applying a first voltage to the heater element until the temperature of the heater element exceeds a high temperature limit; and applying a second, lower voltage to the heater element as the temperature of the heater element decreases.

29. The method of claim 28 further comprising replacing the second voltage with the first voltage when the heater element temperature decreases to a reset value lower than the high temperature limit.

30. The method of claim 26 further comprising continuously supplying voltage to the heater element regardless of the heater element temperature.

* * * * *